US009051100B2

(12) United States Patent
Suzuki

(10) Patent No.: US 9,051,100 B2
(45) Date of Patent: Jun. 9, 2015

(54) CAP AND CONTAINER WITH CAP

(75) Inventor: Yoshihiro Suzuki, Yamagata (JP)

(73) Assignee: Fresh Co., Ltd., Yamagata (JP)

( * ) Notice: Subject to any disclaimer, the term of this patent is extended or adjusted under 35 U.S.C. 154(b) by 383 days.

(21) Appl. No.: 13/061,464

(22) PCT Filed: Aug. 28, 2009

(86) PCT No.: PCT/JP2009/004196

§ 371 (c)(1),
(2), (4) Date: Mar. 29, 2011

(87) PCT Pub. No.: WO2010/023933

PCT Pub. Date: Mar. 4, 2010

(65) Prior Publication Data

US 2011/0204060 A1 Aug. 25, 2011

(30) Foreign Application Priority Data

Sep. 1, 2008 (JP) ..... P2008-224137

(51) Int. Cl.
*B65D 51/28* (2006.01)

(52) U.S. Cl.
CPC ..... *B65D 51/2871* (2013.01)

(58) Field of Classification Search
CPC ..... B65D 51/28; B65D 2543/00685; B65D 2543/00296; B65D 2543/00092; B65D 2543/00509
USPC ..... 220/520, 521, 255.1; 206/221, 219; 604/89, 416, 56; 222/145, 153
See application file for complete search history.

(56) References Cited

U.S. PATENT DOCUMENTS

| | | | | |
|---|---|---|---|---|
| 3,439,823 | A * | 4/1969 | Bruno | 215/6 |
| 4,727,985 | A * | 3/1988 | McNeirney et al. | 206/221 |
| 5,217,433 | A * | 6/1993 | Bunin | 604/89 |
| 5,593,028 | A * | 1/1997 | Haber et al. | 206/221 |
| 5,685,845 | A * | 11/1997 | Grimard | 604/82 |
| 7,854,104 | B2 * | 12/2010 | Cronin et al. | 53/420 |
| 7,980,243 | B2 * | 7/2011 | Hochrainer | 128/200.14 |
| 8,083,055 | B2 * | 12/2011 | Simonian et al. | 206/221 |
| 2006/0118435 | A1 * | 6/2006 | Cronin et al. | 206/219 |

FOREIGN PATENT DOCUMENTS

| | | |
|---|---|---|
| EP | 1582331 | 10/2005 |
| JP | 2007-69952 | 3/2007 |

OTHER PUBLICATIONS

Extended European Search Report dated Sep. 6, 2011.
International Search Report Dated Dec. 1, 2009.

* cited by examiner

*Primary Examiner* — Fenn Mathew
*Assistant Examiner* — Cynthia Collado
(74) *Attorney, Agent, or Firm* — Rankin, Hill & Clark LLP

(57) ABSTRACT

In a bottle cap (10), a bottom cover member (40) is separated from an accommodation portion (22) while an outer peripheral wall (44) of an annular groove is pressed against a lower end surface (39) of an outer cylinder member (30) when a cap portion (26) that is threadedly mounted on the outer cylinder member (30) threadedly advances in an opening direction with respect to the outer cylinder member (30). The lower end surface (39) of the outer cylinder member (30) is inclined downward and outward. A ridge (45) is integrally formed with an upper edge of the outer peripheral wall (44) of the annular groove by the same material as that of the outer peripheral wall (44), where the ridge (45) is pressed against the lower end surface (39) of the outer cylinder member (30) while the cap portion (26) is threadedly mounted on the outer cylinder member (30).

19 Claims, 10 Drawing Sheets

(a)

(b)

(a)

(b)

CAP AND CONTAINER WITH CAP

TECHNICAL FIELD

The present invention relates to a cap and a container with the cap.

BACKGROUND ART

Conventionally, as a cap sealing an opening of a bottle filled with a beverage, a cap has been proposed which includes an accommodation portion accommodating a powdered or liquid raw material therein (for example, refer to Patent Document 1). In the cap, the accommodation portion is opened concomitantly with an opening operation, and the raw material is discharged into the bottle, so that the material is mixed with the beverage.

More specifically, an inner cylinder member including the accommodation portion is attachably/detachably and threadedly mounted on an outer cylinder member fixed to the opening of the bottle. Further, the accommodation portion of the inner cylinder member is sealed in such a manner that the lower end thereof is press-inserted and fitted to a bottom cover member.

In this kind of cap, a problem usually arises in air-tightness of the accommodation portion. The invention disclosed in Patent Document 1 is made to improve the air-tightness of an accommodation portion by integrally forming a packing with an outer peripheral upper edge and an inside portion of an annular groove that allows press-inserting a lower end of the accommodation portion, the material of the packing being softer than that of a bottom cover member.

PRIOR ART DOCUMENT

Patent Document

Patent Document 1: Japanese patent Application Laid-Open (JP-A) No. 2007-69952

DISCLOSURE OF THE INVENTION

However, in the cap disclosed in Patent Document 1, since the packing is formed of a soft resin material such as silicon rubber, the packing may deform independently or change in hardness independently, due to a change in temperature, from the bottom cover member, the inner cylinder member, and the outer cylinder member which are formed of a hard material. For this reason, when the cap is heated or cooled together with the beverage, a problem arises in that the packing may not exhibit the reliable air-tightness.

The invention is made in view of the above-described problems, and provides a cap capable of reliably and air-tightly holding the accommodation portion of the inner cylinder member with high air-tightness, and a container with the cap.

According to the invention, there is provided a cap including: an inner cylinder member which includes a cylindrical accommodation portion having an open lower end so as to accommodate an input material therein and a cap portion sealing an upper end of the accommodation portion; an outer cylinder member which includes an outer cylinder portion allowing the accommodation portion to be inserted therein by attachably/detachably and threadedly mounting the cap portion on an open upper end and allowing an open lower end to be inserted into a container opening together with the accommodation portion, and which is mounted on the container opening; and a bottom cover member which includes an annular groove, in which a lower end of the accommodation portion is raised more than the outer cylinder portion so as to be attachably/detachably press-inserted into the annular groove to be fitted thereto, thereby sealing the accommodation portion, wherein when the cap portion that is threadedly mounted on the outer cylinder member threadedly advances in an opening direction with respect to the outer cylinder member, an outer peripheral wall of the annular groove is pressed down by a lower end surface of the outer cylinder member, so that the bottom cover member is separated from the accommodation portion, wherein the lower end surface of the outer cylinder member is inclined downward and outward, and wherein a ridge is integrally formed with an upper edge of the outer peripheral wall of the annular groove by the same material as that of the outer peripheral wall, said ridge being pressed against the lower end surface of the outer cylinder member while the cap portion is threadedly mounted on the outer cylinder member.

Further, in the cap of the invention, when the cap portion is threadedly mounted on the outer cylinder member, the outer peripheral wall of the annular groove may come into pressing-contact with the lower end of the accommodation portion, and a press-contact load may be applied from the lower end of the accommodation portion to the outer peripheral wall, the press-contact load including a load component applied in a direction where the ridge press-inserts the lower end surface of the outer cylinder member in the axial direction of the outer cylinder member and a load component applied outward in the diameter direction of the bottom cover member.

Further, in the cap of the invention, the ridge may be a triangular ridge of which an outer surface is inclined downward and outward by an inclination angle ($\theta_2$) steeper than a downward inclination angle ($\theta_1$) of the lower end surface of the outer cylinder member.

Further, in the cap of the invention, the inclination angle ($\theta_1$) may be equal to or more than 5° and equal to or less than 30°, and the inclination angle ($\theta_2$) may be equal to or more than 20° and equal to or less than 45°.

Further, in the cap of the invention, the ridge may be pressed against the lower end surface at the substantially center in the thickness direction of the outer cylinder member.

Further, in the cap of the invention, another ridge may be integrally formed inside the annular groove by the same material as that of the outer peripheral wall, thereby sealing a gap between the bottom cover member and the lower end of the accommodation portion by being brought into contact with the lower end.

Further, in the cap of the invention, the entire bottom cover member including the ridge may be formed of a single material.

Further, in the cap of the invention, all of the inner cylinder member, the outer cylinder member, and the bottom cover member may contain a polypropylene resin as a main component.

According to the present invention, there is provided a container with a cap of the invention including a container body which accommodates a mixing material therein and has a container opening formed in an upper end thereof and the cap that is mounted on the container opening of the container body, wherein when the cap portion threadedly advances so that the bottom cover member is separated from the accommodation portion, the input material is mixed with the mixing material.

In the container with the cap of the invention, the mixing material may be a beverage, and the input material may be a powdered material, a granular material, a gelled material, or a liquid material that is dissolved or dispersed in the beverage.

In the container with the cap of the invention, at least one of the mixing material and the input material may be a medicine.

Various components of the invention may not be necessarily discrete parts, but plural components may be integrally formed as a single member, one component may be composed of plural discrete components, a certain component may be a part of another component, or a part of a certain component may be shared with another component.

Further, the vertical direction is stipulated in the invention, but the direction is stipulated only for the convenience of simple description of the correlation between the components. Accordingly, the direction in manufacturing or transporting of the product of the invention is not limited to the stipulated direction.

Advantage of the Invention

According to the cap and the container with the cap of the invention, a drag is applied to the ridge pressed against the lower end surface of the outer cylinder member inclined downward and outward, and the drag includes a component applied in the normal direction of the lower end surface, that is, an inward component in the diameter direction of the bottom cover member. For this reason, a press-contact force applied to the lower end of the accommodation portion that is press-inserted into the annular groove increases due to such pressing force, so that the accommodation portion is sealed with high air-tightness even when the soft packing is not used.

Further, even when a temperature of the cap changes in various patterns, for example, from a normal temperature to a low temperature or a high temperature, the deformation and the temporal change in hardness of the ridge conforms those of the entire bottom cover member because the ridge and the outer peripheral wall of the bottom cover member are formed of the same material. For this reason, the accommodation portion can reliably maintain its sealing performance that is possessed before when the temperature has changed (for example, at a normal temperature).

BRIEF DESCRIPTION OF THE DRAWINGS

The above-described object, other objects, characteristics, and benefits become more apparently understood by the exemplary embodiment to be described below and the drawings thereof.

BEST MODE FOR CARRYING OUT THE INVENTION

Hereinafter, an exemplary embodiment of the invention will be described with reference to the drawings.

In the embodiment, a bottle cap 10 is exemplified as a cap, and a beverage bottle 100 is exemplified as a container with a cap. However, as described below, the container of the invention is not limited to the bottle, and may be a capsule container, a pack container, or the like. Further, the container of the invention may accommodate contents other than a beverage.

Figure 1:
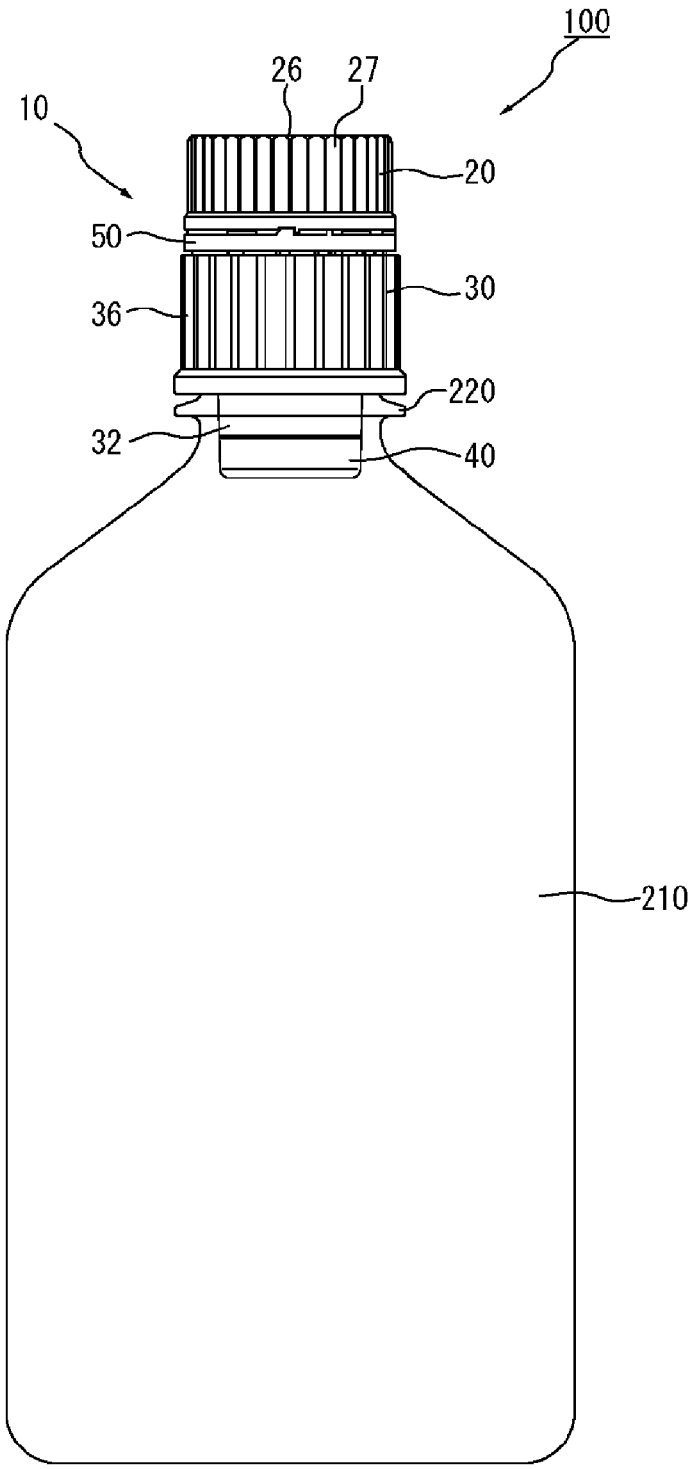
FIG. 1 is a front view illustrating a beverage bottle in which a bottle cap of an exemplary embodiment of the invention is attached to a bottle opening of a bottle body.
Figure 2:
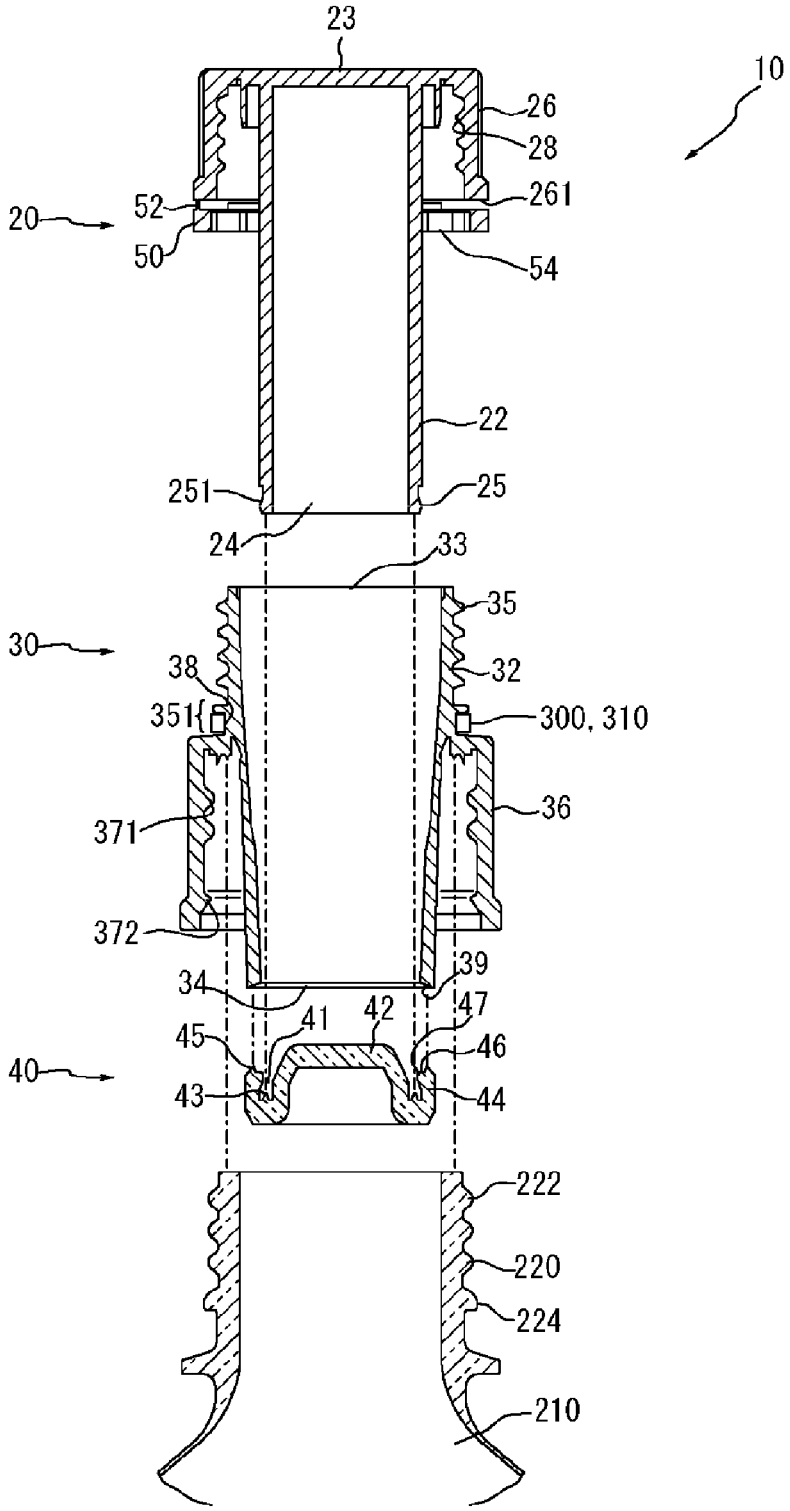
FIG. 2 is a longitudinal sectional front view illustrating an assembly structure of the bottle cap and the beverage bottle.
Figure 3:
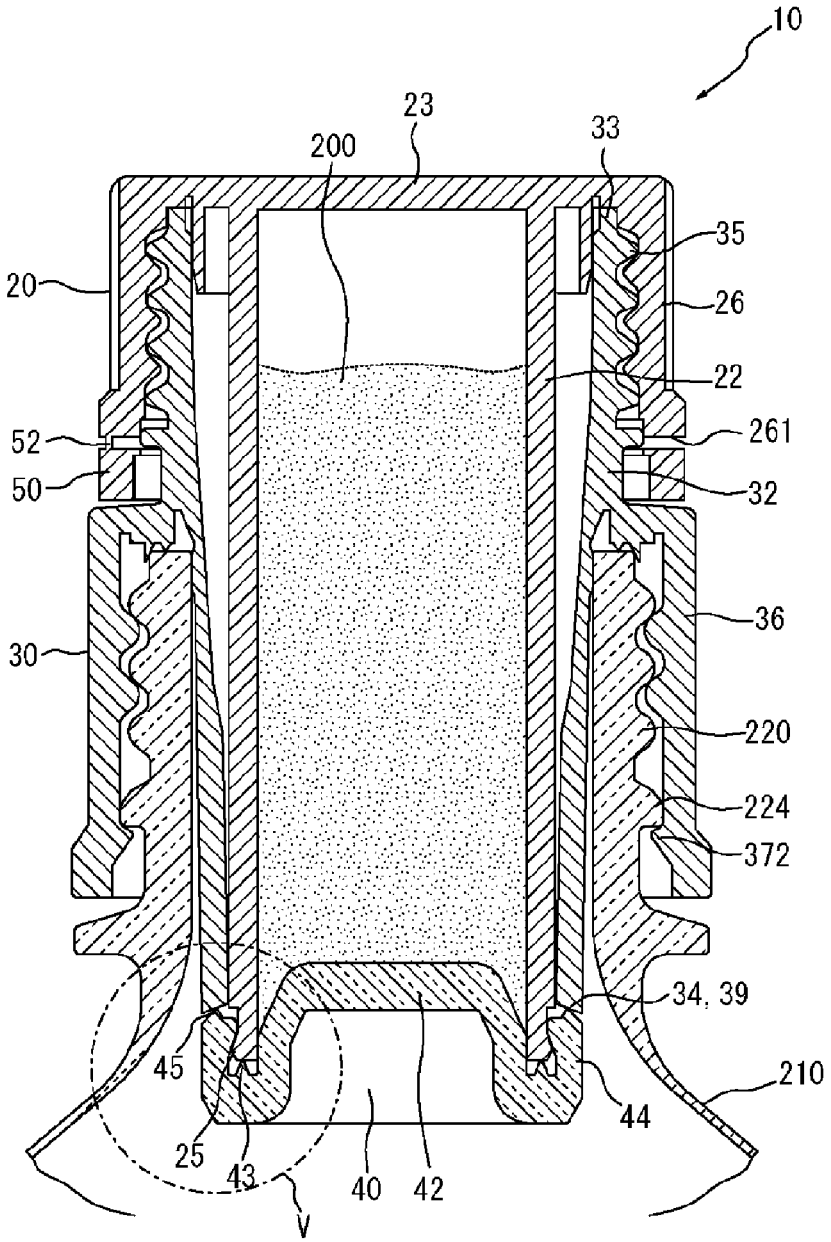
FIG. 3 is a longitudinal sectional front view illustrating a state where the bottle cap is attached to the bottle body.

FIG. 1 is a front view illustrating a beverage bottle 100 in which a bottle cap 10 of the embodiment is attached to a bottle opening 220 of a bottle body 210. FIG. 2 is a longitudinal sectional front view illustrating an assembly structure of the bottle cap 10 and the beverage bottle 100 of the embodiment. A part of the bottle body 210 is not shown in the drawings. FIG. 3 is a longitudinal sectional front view illustrating a state where the bottle cap 10 is attached to the bottle body 210.

<Outline of Bottle Cap>

The bottle cap 10 of the embodiment includes: an inner cylinder member 20; an outer cylinder member 30 attached to the bottle opening 220; and a bottom cover member 40.

The inner cylinder member 20 includes: a cylindrical accommodation portion 22 capable of accommodating an input material 200 by opening a lower end 24; and a cap portion 26 blocking an upper end 23 of the accommodation portion 22.

The outer cylinder member 30 includes an outer cylinder portion 32 in which the cap portion 26 is attachably/detachably and threadedly mounted on an open upper end 33 so that the accommodation portion 22 is inserted into the outer cylinder member 32, and an open lower end 34 is inserted into the bottle opening 220 together with the accommodation portion 22.

The bottom cover member 40 includes an annular groove 41, in which the lower end 24 of the accommodation portion 22 is raised more than the outer cylinder member 32 so as to be attachably/detachably press-inserted into the annular groove 41, thereby sealing the accommodation portion 22.

When the cap portion 26 threadedly mounted on the outer cylinder member 30 threaded advances in the opening direction with respect to the outer cylinder member 30 in the bottle cap 10, an outer peripheral wall 44 of the annular groove 41 is pressed down by a lower end surface 39 of the outer cylinder member 30, so that the bottom cover member 40 is separated from the accommodation portion 22.

Then, in the bottle cap 10 of the embodiment, the lower end surface 39 of the outer cylinder member 30 is inclined downward and outward, and a ridge 45 is integrally formed with an upper edge 46 of the outer peripheral wall 44 of the annular groove 41 by the same material as that of the outer peripheral wall 44, where the ridge 45 is pressed against the lower end surface 39 of the outer cylinder member 30 while the cap portion 26 is threadedly mounted on the outer cylinder member 30.

The beverage bottle 100 of the embodiment includes: the bottle body (container body) 210 accommodating a mixing object (not shown in the drawings) and having the bottle opening (container opening) 220 formed at the upper end thereof; and the bottle cap 10 attached to the bottle opening 220 of the bottle body 210. When the cap portion 26 threadedly advances in the opening direction so that the bottom cover member 40 is separated from the accommodation portion 22, the input material 200 is mixed with the mixing material.

More specifically, the mixing material of the embodiment is a beverage, and the input material 200 is a powder, a granule, a gel, or a liquid that is dissolved or dispersed in the beverage. Specifically, the bottle cap 10 accommodates a dust tea or the like as the input material 200. Further, the bottle body 210 is formed as a so-called polyethylene terephthalate (PET) bottle, and accommodates a liquid such as a freshwater.

In addition, an alcoholic beverage or a dairy product such as milk may be used as the mixing material.

Examples of the input material 200 include stocks of juices or soups, fruit extract, powders of vegetative materials such as tea leaves or turmeric roots, nutritional supplements, health supplements, dairy products, and the like.

However, as described below, the container with the cap of the invention may accommodate a perfume, a detergent, or the like other than a beverage.

The inner cylinder member 20 includes the cap portion 26 and the accommodation portion 22. The cap portion 26 has a holding groove 27 formed in the outer surface thereof, and a female screw portion 28 formed in the inner surface thereof. The cap portion 26 blocks the upper end 23 of the accommodation portion 22, and allows the inner cylinder member 20 to be threadedly mounted on the outer cylinder member 30.

The accommodation portion 22 is a cylindrical member, and the upper end 23 of the accommodation portion 22 is integrally formed with the cap portion 26. The open lower end 24 of the accommodation portion 22 is inserted into the bottle opening 220.

The bottom cover member 40 is fitted into the opening of the lower end 24 of the accommodation portion 22. The lower end 24 of the accommodation portion 22 is inserted into the outer cylinder portion 32 of the outer cylinder member 30 from the upper end 33 toward the lower end 34.

Further, the lower end 24 of the accommodation portion 22 in the invention indicates an area having a predetermined length and disposed near the opening end of the accommodation portion 22.

The outer cylinder member 30 includes the outer cylinder portion 32 and an attachment portion 36. The outer cylinder portion 32 is a cylindrical member without a bottom.

Accordingly, all of the inner cylinder member 20, the outer cylinder member 30, and the bottle cap 10 including the members are formed in a cylindrical shape. Hereinafter, the "diameter direction" indicates the radial direction of the bottle cap 10 unless a particular remark is made. In the same way, the "axial direction" indicates the axial direction of the bottle cap 10, that is, the insertion direction of the accommodation portion 22 toward the bottle opening 220.

As shown in FIGS. 2 and 3, the upper end 33 of the outer cylinder portion 32 is threaded into the cap portion 26 of the inner cylinder member 20, and the lower end 34 is inserted into the bottle opening 220. Accordingly, a male screw portion 35 is formed in the upper portion of the outer cylinder portion 32.

The inside of the outer cylinder portion 32 is formed in a tapered shape of which the diameter is reduced from the upper end 33 toward the lower end 34, and the outer peripheral surface of the accommodation portion 22 of the inner cylinder member 20 loosely inserted from the upper end 33 of the outer cylinder portion 32 comes into sliding-contact with the inner peripheral surface of the outer cylinder portion 32 near the lower end 34.

Then, the outer cylinder portion 32 of the embodiment has the lower end 34 inclined downward and outward in the diameter direction.

In the outer cylinder portion 32, a latch claw is provided in an outer peripheral surface of a head portion 351 below the male screw portion 35 so that the transverse direction is the latch direction. An attachment portion 36 is provided below the latch claw. The attachment portion 36 and the outer cylinder portion 32 form a double cylindrical structure, where a female screw portion 371 is provided at the center portion of the inner peripheral surface of the attachment portion 36, and a latch portion 372 is provided at the lower portion thereof. The attachment portion 36 and the outer cylinder portion 32 are integrally formed with each other.

A male screw portion 222 is formed in the bottle opening 220, and a latch ring 224 is formed in the lower portion of the male screw portion 222.

The inclination of the lower surface of the latch portion 372 is gentler than that of the upper surface. Further, the inclination of the upper surface of the latch ring 224 is gentler than that of the lower surface.

The outer cylinder member 30 is attached to the bottle body 210 in such a manner that the female screw portion 371 of the attachment portion 36 is screwed with respect to the male screw portion 222 of the bottle opening 220. Then, when the female screw portion 371 is sufficiently screwed and the latch portion 372 jumps over the latch ring 224, both the latch portion and the latch ring engage with each other. Accordingly, the looseness of the outer cylinder member 30 attached to the bottle body 210 is regulated.

<Bottom Cover Member>

Figure 4:
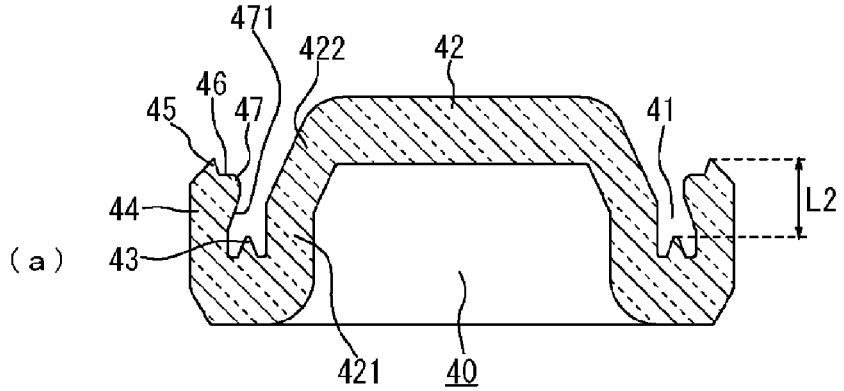
FIG. 4(*a*) is a longitudinal sectional view illustrating a bottom cover member, and FIG. 4(*b*) is a bottom view thereof.
Figure 4:
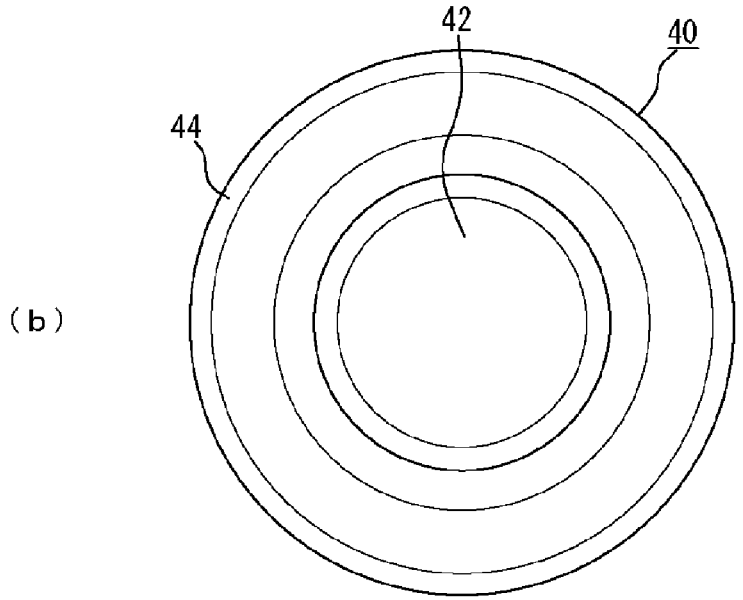

FIG. 4(*a*) is a longitudinal sectional view illustrating the bottom cover member 40 of the embodiment, and FIG. 4(*b*) is a bottom view thereof.

The bottom cover member 40 is a member that is attached to the opening of the lower end 24 of the accommodation portion 22 so as to seal the accommodation portion 22. The bottom cover member 40 mainly includes: a bottom plate portion 42 which is press-inserted into the opening of the accommodation portion 22 so as to seal the opening; the outer peripheral wall 44 which is uprightly formed in the peripheral edge of the bottom plate portion 42; and the annular groove 41 which is formed between the outer peripheral wall 44 and the bottom plate portion 42 and allows the lower end 24 of the accommodation portion 22 to be press-inserted and fitted into the annular groove 41.

The bottom plate portion 42 includes: an inner peripheral wall 421 which forms the annular groove 41 together with the outer peripheral wall 44; and a slope portion 422 of which a diameter is reduced in a tapered shape in the upper portion of the inner peripheral wall 421.

Since the slope portion 422 is formed in a tapered shape, the bottom plate portion 42 may be easily press-inserted into the lower end 24 of the accommodation portion 22.

The bottom cover member 40 of the embodiment includes a ridge 45 which is formed in the upper edge 46 of the outer peripheral wall 44. The ridge 45 is a ridge which is pressed from the lower end surface 39 of the outer cylinder member 30 so as to seal a gap between the outer peripheral wall 44 and the lower end surface 39 while the cap portion 26 is threadedly mounted on the outer cylinder member 30.

The ridge 45 is integrally formed with the outer peripheral wall 44 by the same material.

Further, as shown in FIG. 3, a lower end ridge 25 is formed in the outer peripheral surface of the lower end 24 of the accommodation portion 22 so as to be press-inserted into the annular groove 41.

The accommodation portion 22 is formed to be longer than the outer cylinder portion 32 of the outer cylinder member 30. When the cap portion 26 of the inner cylinder member 20 is completely threadedly mounted on the male screw portion 35 of the outer cylinder member 30, the lower end ridge 25 of the accommodation portion 22 is raised downward more than the lower end 34 of the outer cylinder portion 32.

When the input material 200 is input to the accommodation portion 22 in such a state, and the lower end ridge 25 of the accommodation portion 22 is press-inserted and fitted into the annular groove 41, the bottom cover member 40 is attached to the accommodation portion 22.

A swollen portion 47 is formed in the inner wall surface of the upper edge 46 of the outer peripheral wall 44. Then, when the lower end ridge 25 of the accommodation portion 22 is fitted into the annular groove 41, the swollen portion 47 engages with the lower end ridge 25, and hence the bottom cover member 40 is prevented from being separated from the accommodation portion 22.

The engagement method between the swollen portion 47 and the lower end ridge 25 will be described in detail below.

Another ridge (inner groove ridge 43) is formed in the inner bottom surface of the annular groove 41 so as to seal a gap between the bottom cover member 40 and the lower end 24 by being brought into contact with the lower end 24 of the accommodation portion 22, and is integrally formed inside the annular groove 41 by the same material as that of the outer peripheral wall 44.

The inner groove ridge 43 is a ridge which is pressed against an end surface 252 (refer to FIG. 5) of the lower end 24 of the accommodation portion 22 when the lower end ridge 25 of the accommodation portion 22 is press-inserted into the annular groove 41, and air-tightly seals a gap between the bottom cover member 40 and the accommodation portion 22. Accordingly, the input material 200 input into the accommodation portion 22 is doubly sealed inside the bottle body 210 by the inner groove ridge 43 and the ridge 45.

Next, the material and the like of the respective members constituting the bottle cap 10 with such a configuration will be described.

In the bottle cap 10 with such a configuration, all of the inner cylinder member 20, the outer cylinder member 30, and the bottom cover member 40 contain a polypropylene resin as a main component (resin component), and additives such as lubricant and colorant are appropriately added to the resin component.

Here, examples of the polypropylene resin include: homopolypropylene, a propylene random copolymer (random polypropylene) as a copolymer of α-olefin monomer (ethylene and the like) and propylene, and a propylene block copolymer (block polypropylene). α-olefin other than propylene may be used as the α-olefin monomer, and examples thereof include ethylene, 1-butene, 1-pentene, 1-hexene, 4-methyl-1-pentene, 1-heptene, 1-octene, and the like. Among these examples, ethylene and 1-butene are preferable, and particularly ethylene is appropriate. Further, α-olefin may be used alone or with two or more combinations.

Since all of the inner cylinder member 20, the outer cylinder member 30, and the bottom cover member 40 contain the polypropylene resin as a main component, a difference in the linear expansion coefficient between these members is suppressed to be extremely small. For this reason, a change in the air-tightness of the accommodation portion 22 is suppressed even when the temperature of the bottle cap 10 changes. For example, when the beverage bottle 100 is a beverage PET bottle, the bottle cap 10 is accommodated in the temperature range of 10 to 50° C. in many cases. However, in any case, the air-tightness between the bottom cover member 40 and the accommodation portion 22 may be maintained to be substantially the same as that of the normal temperature (20° C.)

Here, since the main materials of the inner cylinder member 20, the outer cylinder member 30, and the bottom cover member 40 are in common with each other, the fluctuation in the opening torque of the bottle cap 10 may be suppressed in the case where the beverage bottle 100 is accommodated at a low temperature (equal to or less than a normal temperature) or is accommodated at a high temperature (equal to or more than a normal temperature).

Further, from the viewpoint of the reduction in the opening torque of the bottle cap 10, the inner cylinder 20, the outer cylinder 30, and the bottom cover member 40 may contain a silicon resin. An example of the silicon resin may include dimethylpolysiloxane.

The composition amount of the silicon resin is not particularly limited, but the silicon resin is contained in the range equal to or more than 0.1 wt % and equal to or less than 10 wt % with respect to the inner cylinder member 20, the outer cylinder member 30, and the bottom cover member 40.

Specifically, the silicon resin is contained in the range equal to or more than 0.5 wt % and equal to or less than 5 wt % with respect to the inner cylinder member 20 and the outer cylinder member 30. Further, the silicon resin is contained in the range equal to or more than 1 wt % and equal to or less than 10 wt % with respect to the bottom cover member 40.

Further, silicon is preferably contained in the range equal to or more than 0.2 wt % and equal to or less than 0.8 wt % with respect to the inner cylinder member 20 and the outer cylinder member 30, and is preferably contained in the range equal to or more than 0.4 wt % and equal to or less than 3.8 wt % with respect to the bottom cover member 40.

The bending elastic modulus (JIS K 6921-2(ISO 1873-2.2:95)) of the outer cylinder member 30 is preferably equal to or less than 1200 MPa. Further, the surface hardness (JIS K 7202 (ISO 2039-2) (R scale)) of the outer cylinder member 30 is preferably equal to or more than 85.

In particular, the bending elastic modulus (JIS K 6921-2) is more preferably equal to or less than 1100 MPa, and is further more preferably equal to or more than 800 MPa from the viewpoint of the ensured rigidity of the bottle cap 10.

Further, the surface hardness (JIS K 7202 (R scale)) of the outer cylinder member 30 is more preferably equal to or more than 90, and is further more preferably equal to or less than 110.

In the material forming the outer cylinder member 30, the heat distortion temperature (JIS K 6921-2 (ISO 1873-2.2:95)) is preferably equal to or more than 90° C., and is more preferably equal to or more than 100° C.

The material property may be satisfied by using, for example, PM870A or PM870Z manufactured by SunAllomer Ltd. or J784HV manufactured by Prime Polymer Co., Ltd. as a resin component of the material forming the outer cylinder member 30.

Further, the surface hardness (JIS K 7202 (R scale)) of the material forming the outer cylinder member 30 is lower than the surface hardness (JIS K 7202 (R scale)) of the material forming the bottle body 210.

The inner cylinder member 20 and the bottom cover member 40 are formed of a material having a surface hardness different from that of the outer cylinder member 30.

An example of the polypropylene resin forming the inner cylinder member 20 and the bottom cover member 40 includes J706WB or J707EG manufactured by Prime Polymer Co., Ltd.

Colorant may be contained in the range of 1 to 10 wt % with respect to the inner cylinder member 20, the outer cylinder member 30, and the bottom cover member 40.

Here, the bending elastic modulus is measured according to JIS K 6921-2. Specifically, the bending elastic modulus is elastic modulus that is calculated from a load-flexure curve obtained by a 3-point bending test. Here, the bending elastic modulus of each member of the bottle cap 10 is set as the elastic modulus that is obtained on the assumption that the measurement temperature is a "normal temperature", the sample shape is 80×10×4 mm (length×height×width), and the test condition (speed) is 2 mm/min.

Further, the surface hardness is measured according to JIS K 7202, and is Rockwell hardness (R scale).

Further, the heat distortion temperature is measured according to JIS K 6921-2.

A test is conducted in such a manner that a sample shape is set as 80×10×4 mm (length×height×width), 3-point bending stress is loaded at 0.45 MPa, and the temperature of the sample is increased at 2° C./min in oil. When the test piece is softened to reach flexure (0.32 mm) of the load point as a result of the test, the measurement temperature at this time is used as the heat distortion temperature of each member of the bottle cap 10.

Further, whether the outer cylinder member 30 is formed of a material having the above-described material properties (the bending elastic modulus, the surface hardness, and the heat distortion temperature) may be checked in such a manner that the outer cylinder member 30 is melted and formed in a sample shape to measure the material properties, and the material properties are measured.

In the case of the embodiment, the entire bottom cover member 40 including the ridge 45 and the inner groove ridge 43 is formed of a single material.

Here, since the entire bottom cover member 40 including the ridge 45 is formed of a single material, the recyclability of the bottle cap 10 becomes satisfactory as a whole. Further, the molding process becomes simple and the cost becomes low. Further, when the container with the cap of the invention accommodates medicine as described below, the risk of spoiling the medicine due to the reaction with the bottom cover member 40 may be reduced by manufacturing the bottom cover member 40 using a single material so as to decrease the number of types of the materials contacting the medicine.

<Sealed State of Accommodation Portion>

Figure 5:
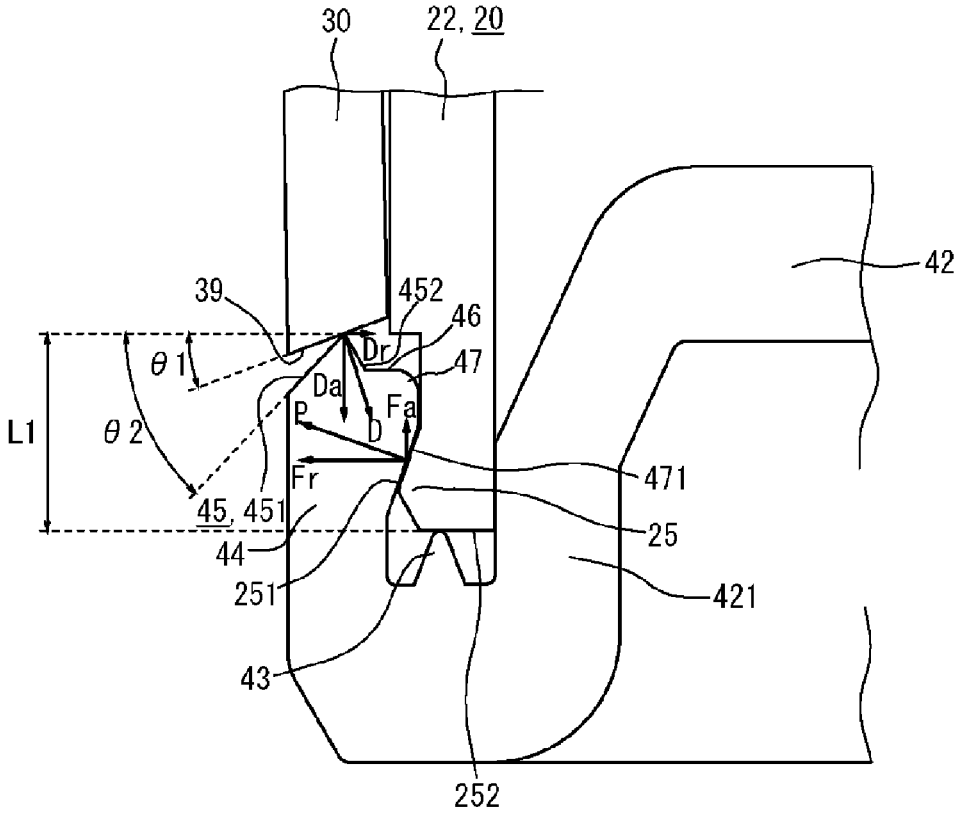
FIG. 5 is an enlarged view illustrating an area surrounded by a circle V in FIG. 3.

FIG. 5 is an enlarged view illustrating an area surrounded by a circle V in FIG. 3. The sealed state of the accommodation portion 22 in the bottle cap 10 of the embodiment will be described by referring to the same drawing.

A lower surface 471 of the swollen portion 47 raised toward the inside of the outer peripheral wall 44 is reduced in the diameter and is inclined with respect to the separation direction of the accommodation portion 22 corresponding to the upside in FIG. 5. In other words, the groove width of the annular groove 41 is widened inward. Then, the swollen portion 47 corresponding to the opening edge of the annular groove 41 is raised toward the inside of the annular groove 41, so that the annular groove 41 is formed in a so-called undercut shape.

On the other hand, an upper surface 251 of the lower end ridge 25 of the accommodation portion 22 is enlarged in the diameter and is inclined toward the lower end 24 of the accommodation portion 22. In other words, the upper surface 251 of the lower end ridge 25 is inclined downward and toward the outside of the accommodation portion 22.

When the lower end ridge 25 of the accommodation portion 22 is fitted into the annular groove 41, the lower end 24 of the accommodation portion 22 including the lower end ridge 25 is sandwiched between the outer peripheral wall 44 and the inner peripheral wall 421. Then, the lower end ridge 25 engages with the swollen portion 47, and the upper surface 251 of the lower end ridge 25 comes into pressing-contact with the lower surface 471 of the swollen portion 47.

That is, in the bottom cap 10 of the embodiment, the outer peripheral wall 44 of the annular groove 41 comes into pressing-contact with the lower end 24 of the accommodation portion 22 while the cap portion 26 is threadedly mounted on the outer cylinder member 30.

Then, in the bottle cap 10, a press-contact load P is applied from the lower end 24 of the accommodation portion 22 toward the outer peripheral wall 44 as shown in FIG. 5, where the press-contact load includes a load component Fa applied in a direction (the upside in the drawing) where the ridge 45 presses the lower end surface 39 of the outer cylinder member 30 in the axial direction of the outer cylinder member 30 and a load component Fr applied to the outside (the left side in the drawing) in the diameter direction of the bottom cover member 40.

This is because all of the lower surface 471 of the swollen portion 47 and the upper surface 251 of the lower end ridge 25 which come into pressing-contact with each other are inclined downward and outward in the diameter direction, and hence the load direction of the press-contact load P applied from the upper surface 251 toward the lower surface 471 faces the oblique upside of the diameter direction as the normal direction of the upper surface 251.

Here, in the outer cylinder member 30 of the embodiment, the lower end surface 39 is inclined downward and outward. For this reason, a drag D against the press-contact load P is applied to the ridge 45 coming into contact with the lower end surface 39 in the normal direction of the lower end surface 39.

Then, the lower end ridge 25 receives a radial component Dr of the drag D as a reaction force of the load component Fr of the press-contact load P and the elastic reaction force of the outer peripheral wall 44 including the swollen portion 47. For this reason, the sandwiching force applied to the accommodation portion 22 by the outer peripheral wall 44 and the inner peripheral wall 421 increases, and the sealing performance between the accommodation portion 22 and the bottom cover member 40 is improved.

Further, the separation of the accommodation portion 22 from the annular groove 41 is regulated, and the bottom cover member 40 is prevented from being easily separated from the accommodation portion 22 by the own weight of the bottom cover member 40 or the input material 200.

On the other hand, in the press-contact load P applied from the lower end ridge 25 to the swollen portion 47, a part of the load component Fa which is an axial component of the outer cylinder member 30 is applied to the lower end surface 39 of the outer cylinder member 30 fixed to the bottle opening 220 in the form of a load in which the ridge 45 presses the lower end surface 39 upward. Then, an axial component Da of the drag D applied from the lower end surface 39 is applied to the ridge 45 in the axial direction of the outer cylinder member 30. Accordingly, the ridge 45 and the lower end surface 39 satisfactorily come into close contact with each other.

That is, in the embodiment, a press-inserting force when the lower end ridge 25 of the accommodation portion 22 is fitted to the annular groove 41 is converted into a close contact force between the ridge 45 and the lower end surface 39, so that the sealing performance between the outer cylinder member 30 and the bottom cover member 40 is improved.

Here, the ridge 45 is a triangular ridge of which an outer surface 451 is inclined downward and outward by an inclination angle $\theta_2$ steeper than a downward inclination angle $\theta_1$ of the lower end surface 39 of the outer cylinder member 30.

That is, in the ridge 45 provided in the annular upper edge 46 in the substantially disc-shaped bottom cover member 40, the longitudinal section taken along the axial direction of the bottom cover member 40 is an upward triangular shape.

Then, since the outer surface 451 of the ridge 45 is inclined so as to be steeper than the lower end surface 39, these surfaces are not interfered with each other.

Further, since the ridge 45 is a triangular ridge having a narrow upper end, the distortion property of the ridge 45 becomes satisfactory. For this reason, the upper end of the ridge 45 receiving the drag D from the lower end surface 39 as described above is deformed and slightly distorted, so that the ridge 45 strongly comes into close contact with the lower end surface 39.

Here, the downward inclination angle $\theta_1$ of the lower end surface 39 is preferably equal to or more than 5° and equal to or less than 30°. Then, the downward inclination angle $\theta_2$ of the outer surface 451 is preferably larger than the inclination angle $\theta_1$, and equal to or more than 20° and equal to or less than 45°.

Further, the inclination angle of the inner surface 452 that inwardly slopes down from the head portion of the ridge 45 toward the inside of the annular groove 41 is not particularly limited.

The ridge 45 is pressed against the lower end surface 39 at the substantially center of the outer cylinder member 30 in the thickness direction.

In the state where the cap portion 26 is threadedly mounted on the outer cylinder member 30, the axial distance $L_1$ from the end surface 252 of the accommodation portion 22 to the center of the lower end surface 39 of the outer cylinder member 30 in the thickness direction is shorter than the distance $L_2$ (refer to FIG. 4) from the upper end of the inner grove ridge 43 of the bottom cover member 40 to the upper end of the ridge 45.

The overlap length between the ridge 45 and the lower end surface 39, that is, the length obtained by subtracting the distance $L_1$ from the distance $L_2$ is not particularly limited.

When the outer cylinder member 30 and the bottom cover member 40 are formed of a hard resin material mainly containing a polypropylene resin, for example, the height of the ridge 45 from the upper edge 46 of the outer peripheral wall 44 may be set to be 0.4 to 0.8 mm, and the overlap length may be 0.2 to 1.2 mm.

For this reason, when the bottom cover member 40 is attached to the accommodation portion 22 while the cap portion 26 is threadedly mounted on the outer cylinder member 30, the ridge 45 and the inner groove ridge 43 are respectively pressed against the lower end surface 39 of the outer cylinder member 30 and the end surface 252 of the accommodation portion 22, and the upper ends thereof are elastically or plastically distorted.

At this time, the ridge 45 receives the radial component Dr of the drag D from the lower end surface 39, so that the ridge 45 is deformed inward in the diameter direction and slides upward along the inclined lower end surface 39.

Accordingly, the upper end of the ridge 45 may be formed so as to come into contact with the substantially center of the lower end surface 39 in the thickness direction, that is, a predetermined width of the lower end surface including the center instead of the vicinity of the edge of the lower end surface 39 in consideration of processing precision of the bottom cover member 40, the inner cylinder member 20, and the outer cylinder member 30, and a balance and a distortion amount in which the outer peripheral wall 44 is pressed and deformed outward in the diameter direction by the lower end ridge 25.

Then, since the inclination angle $\theta_1$ of the lower end surface 39 is set to be within the above-described range, the balance between the radial component Dr and the axial component Da of the drag D with respect to the ridge 45 becomes excellent, and the sealing performance between the outer cylinder member 30 and the bottom cover member 40 and the sealing performance between the accommodation portion 22 and the bottom cover member 40 become satisfactory.

The end surface 252 of the accommodation portion 22 comes into pressing-contact with the inner groove ridge 43 at a predetermined pressing force by the load component Fa applied from the lower end ridge 25 to the outer peripheral wall 44.

Here, the inner groove ridge 43 is also a triangular ridge of which the longitudinal sectional shape is an upward triangular shape. Accordingly, the upper end of the inner groove ridge 43 is deformed and slightly distorted by the pressing force from the end surface 252, so that the inner groove ridge 43 strongly comes into close contact with the end surface 252.

Accordingly, in the bottle cap 10 of the embodiment, the sealing performance between the accommodation portion 22 and the bottom cover member 40 becomes satisfactory.

<Opening Operation of Accommodation Portion>

As shown in FIGS. 2 and 3, the bottle cap 10 of the embodiment includes a band portion 50 which is used to check whether the cap portion 26 is opened. The band portion 50 is partially connected to a lower edge 261 of the cap portion 26 by a weak bridge 52. The bridge 52 is connected to the upper surface of the band portion 50 and the inner peripheral surface or the outer peripheral surface thereof.

The band portion 50 is integrated with the inner cylinder member 20 via the cap portion 26, and is threadedly mounted on the outer cylinder member 30. When the female screw portion 28 of the inner cylinder member 20 rotates in the right-screw direction, the female screw portion is threaded into the male screw portion 35 of the outer cylinder member 30 in the closing direction. On the other hand, when the inner cylinder member 20 rotates in the left-screw direction with respect to the outer cylinder member 30, the cap portion 26 rotates in the opening direction so as to be separated from the male screw portion 35 of the outer cylinder portion 32.

Plural latch claws are formed in the inner peripheral surface 54 of the band portion 50 and the outer peripheral surface 38 of the outer cylinder member 30. The latch claws regulate the rotation of the band portion 50 with respect to the outer cylinder member 30 in the opening direction of the cap portion 26, and permit the rotation in the closing direction thereof.

Accordingly, when the band portion 50 screwed together with the inner cylinder member 20 reaches the head portion 351 of the outer cylinder member 30, the band portion 50 may rotate in the closing direction together with the cap portion 26. On the other hand, the rotation of the band portion 50 is prevented in the opening direction of the cap portion 26 after the latch claws engage with each other. Accordingly, when the inner cylinder member 20 is opened while the bottle cap 10 is fixed to the bottle body 210, the cap portion 26 threadedly advances while rotating in the opening direction with respect to the male screw portion 35. On the other hand, since the rotation of the band portion 50 with respect to the outer cylinder member 30 is regulated due to the engagement between the latch claws, the relative positions of the band portion 50 and the cap portion 26 are separated from each other, and the weak bridge 52 is broken. In this way, the open state of the cap portion 26 is checked.

Figure 6:
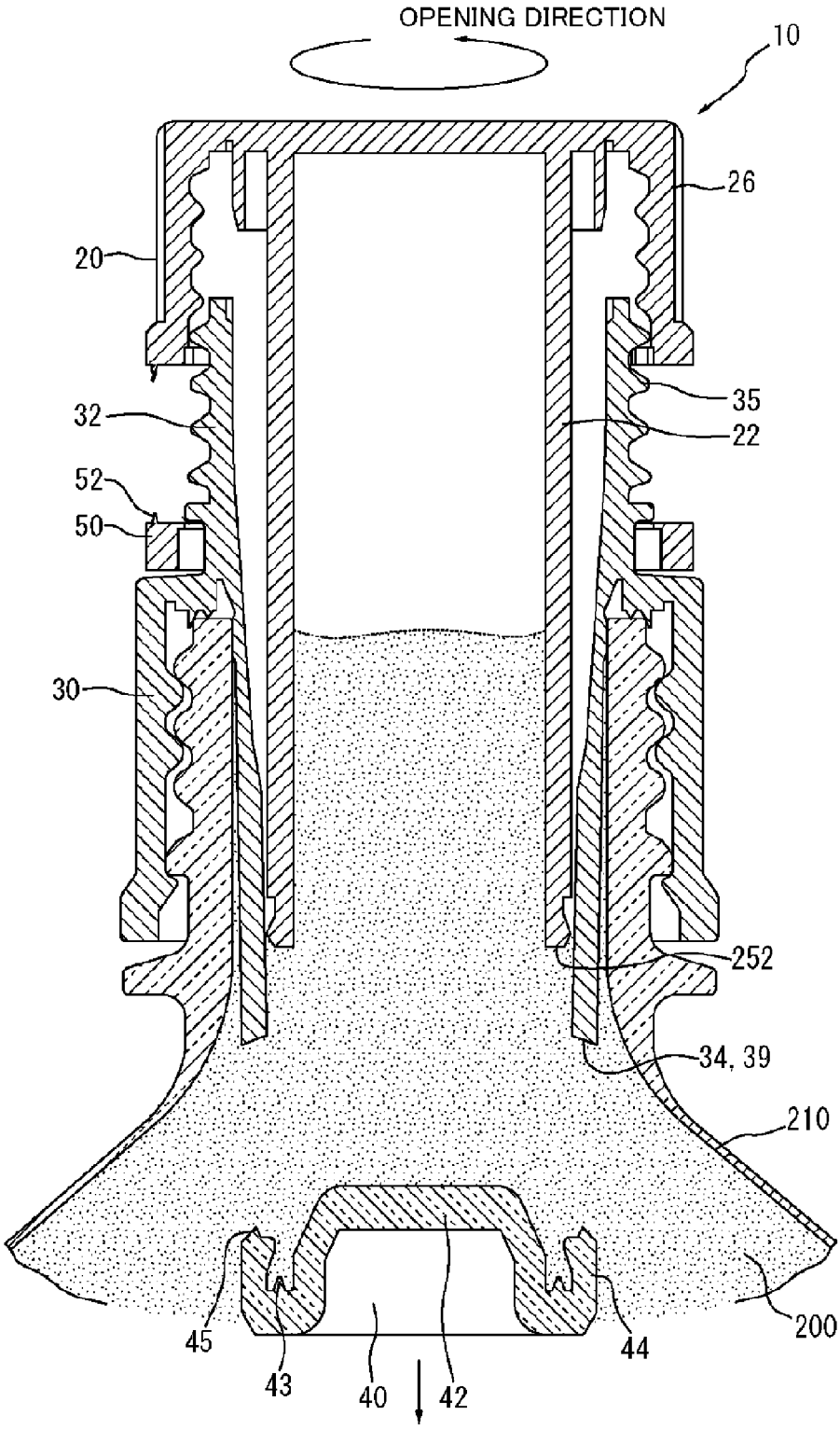
FIG. 6 is a longitudinal sectional front view illustrating a state where a cap portion is opened.

FIG. 6 is a longitudinal sectional front view illustrating an open state of the cap portion 26.

As shown in the same drawing, when a general customer opens the cap portion 26 of the beverage bottle 100 so that the bottom cover member 40 is separated from the accommodation portion 22, the customer may drink a liquid inside the bottle body 210 and the input material 200 accommodated in the accommodation portion 22.

When the cap portion 26 is rotated in the opening direction with respect to the male screw portion 35 of the outer cylinder portion 32, the cap portion 26 threadedly advances upward with respect to the outer cylinder member 30. Since the outer peripheral wall 44 of the bottom cover member 40 is locked to the lower end 34 of the outer cylinder member 30 so as to regulate the upward movement thereof, when the cap portion 26 threadedly advances by a predetermined length, the engagement between the end surface 252 of the accommodation portion 22 and the inner groove ridge 43 and the engagement between the lower end surface 39 of the outer cylinder member 30 and the ridge 45 are released. For this reason, the bottom plate portion 42 of the bottom cover member 40 is separated from the accommodation portion 22, so that the input material 200 accommodated in the accommodation portion 22 is input to the bottom body 210.

At this time, since the rotation of the band portion 50 in the opening direction is regulated by its latching to the outer cylinder member 30, the band portion 50 does not follow the threadedly advancing movement of the cap portion 26. For this reason, the bridge 52 of which one end is connected to the cap portion 26 is lengthened and broken. In this way, the open state of the cap portion 26 is checked.

Further, the invention is not limited to the above-described embodiment, but may include various modifications and corrections as long as the object of the invention is achieved.

Figure 7:
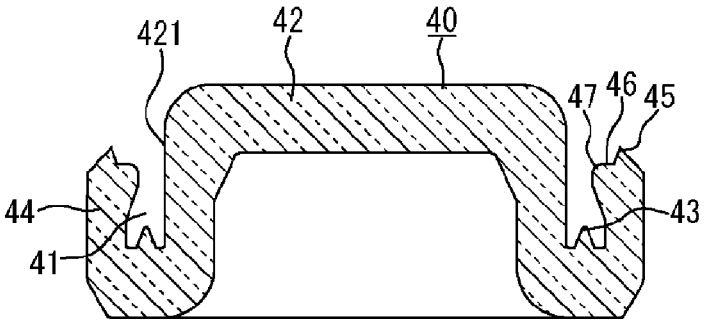
FIG. 7(*a*) is a longitudinal sectional view illustrating a bottom cover member according to a first modified example, and FIG. 7(*b*) is a bottom view thereof.
Figure 7:
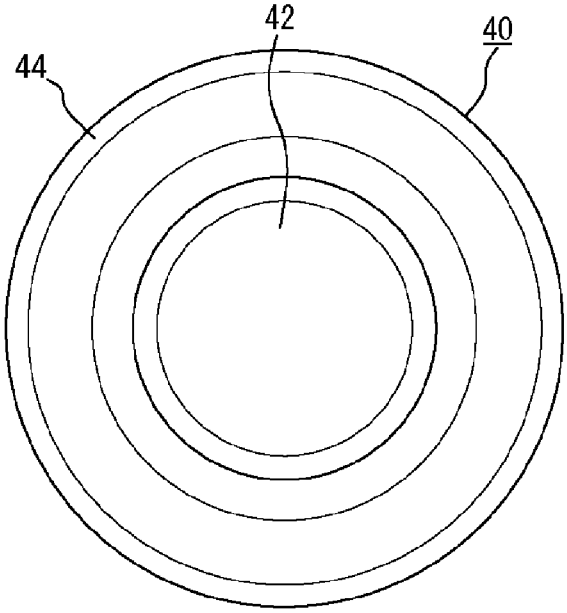

FIG. 7(*a*) is a longitudinal sectional view illustrating the bottom cover member 40 according to a first modified example, and FIG. 7(*b*) is a bottom view thereof.

The bottom cover member 40 of this example is different from the above-described embodiment in that the inner peripheral wall 421 of the annular groove 41 is uprightly formed in the normal direction of the bottom plate portion 42, and the slope portion 422 (refer to FIG. 4) is not formed in the upper portion of the inner peripheral wall 421.

In the case of this example, since the inner peripheral wall 421 comes into close contact with the inner peripheral surface of the lower end 24 (refer to FIG. 2) of the accommodation portion 22 when the cap portion 26 is threadedly mounted on the outer cylinder member 30, the sealing performance between the accommodation portion 22 and the bottom cover member 40 becomes satisfactory.

Figure 8:
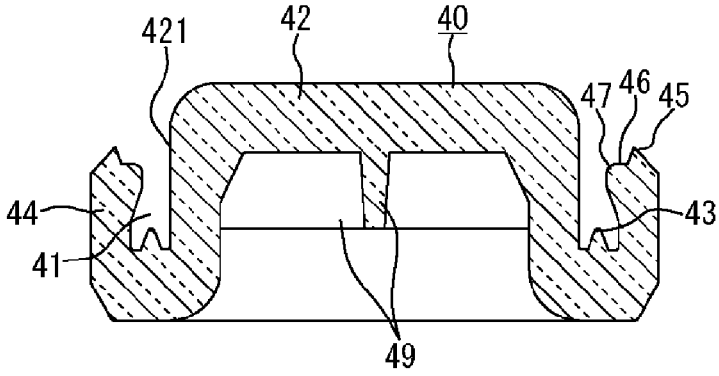
FIG. 8(*a*) is a longitudinal sectional view illustrating a bottom cover member according to a second modified example, and FIG. 8(*b*) is a bottom view thereof.
Figure 8:
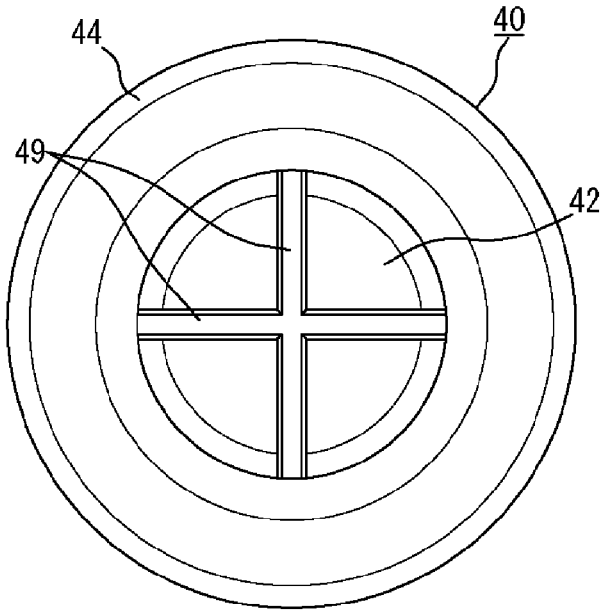

FIG. 8(*a*) is a longitudinal sectional view illustrating the bottom cover member 40 according to a second modified example, and FIG. 8(*b*) is a bottom view thereof.

The bottom cover member 40 of this example is different from the first modified example in that a cross-shaped rib 49 is uprightly formed in the lower surface of the bottom plate portion 42.

The rib 49 is integrally formed with the bottom plate portion 42 and the outer peripheral wall 44 by the same material. In the case of this example, the rib 49 extends in the diameter direction of the bottom cover member 40.

Accordingly, when the lower end ridge 25 of the accommodation portion 22 is press-inserted into the annular groove 41, the inner peripheral wall 421 is suppressed from being elastically deformed inward in the diameter direction of the bottom cover member 40. Accordingly, the press-inserting force of the lower end ridge 25 is solely converted into the press-contact force to the swollen portion 47 (lower surface 471) of the outer peripheral wall 44. Accordingly, in this example, since the close-contact force between the ridge 45 and the lower end surface 39 is improved, the high sealing performance may be obtained between the outer cylinder member 30 and the bottom cover member 40.

Figure 9:
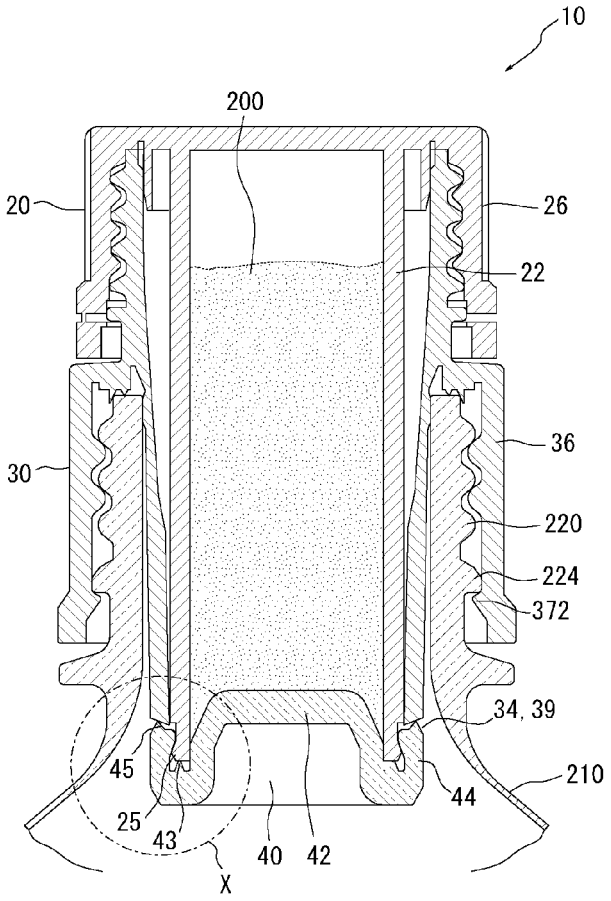
FIG. 9 is a longitudinal sectional front view illustrating a state where a bottle cap is attached to a bottle body according to another example.

FIG. 9 is a longitudinal sectional front view illustrating a state where the bottle cap 10 is attached to the bottle body 210 according to another example.

Figure 10:
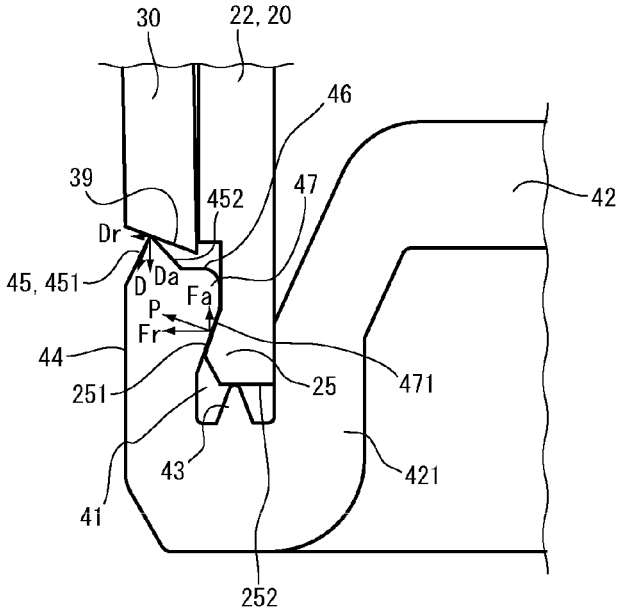
FIG. 10 is an enlarged view illustrating an area surrounded by a circle X in FIG. 9.

FIG. 10 is an enlarged view illustrating an area surrounded by a circle X in FIG. 9.

The bottle cap 10 of this example is different from the embodiment shown in FIG. 3 in that the inclination direction of the lower end surface 39 of the outer cylinder member 30 is reversed. That is, in the bottle cap 10 of this example, the lower end surface 39 of the outer cylinder member 30 is inclined downward and inward as shown in FIGS. 9 and 10. Further, the ridge 45 is integrally formed with the upper edge 46 of the outer peripheral wall 44 of the annular groove 41 by the same material as that of the outer peripheral wall 44, where the ridge 45 is pressed against the lower end surface 39 of the outer cylinder member 30 while the cap portion 26 is threadedly mounted on the outer cylinder member 30.

The outer surface 451 and the inner surface 452 of the ridge 45 are inclined so as to be steeper than the lower end surface 39 of the outer cylinder member 30.

When the lower end ridge 25 of the inner cylinder member 20 threadedly mounted on the outer cylinder member 30 is press-inserted into the annular groove 41 of the bottom cover member 40, the vicinity of the head portion of the ridge 45 of the bottom cover member 40 comes into close contact with the lower end surface 39 of the outer cylinder member 30. The upper end of the ridge 45 is formed in a tapered shape of which the width is narrow, and the vicinity of the head portion is very flexible. For this reason, when the upper end of the ridge 45 comes into pressing-contact with the lower end surface 39 of the outer cylinder member 30, the upper end is deformed in the normal direction (outward in the diameter direction) of the lower end surface 39.

The downward inclination angle of the lower end surface 39 is preferably equal to or more than 5° and equal to or less than 30°. Then, the downward inclination angle of the inner surface 452 is preferably larger than the downward inclination angle of the lower end surface 39, and equal to or more than 20° and equal to or less than 45°. Further, the downward inclination angle of the outer surface 451 is preferably larger than the downward inclination angle of the inner surface 452.

The overlap length between the ridge 45 and the lower end surface 39 may be the same as that of the above-described embodiment.

As shown in FIG. 10, even in the case of the bottle cap 10 of this example, the directions of the load components Fa and Fr applied from the lower end ridge 25 of the inner cylinder member 20 to the outer peripheral wall 44 in the axial and diameter directions are the same as those of the above-described embodiment (refer to FIG. 5). That is, the press-contact load P applied from the lower end ridge 25 of the inner cylinder member 20 to the outer peripheral wall 44 includes the load component Fa applied upward in the axial direction of the outer cylinder member 30 and the load component Fr applied outward in the diameter direction of the bottom cover member 40.

In the bottle cap 10 of this example, since the lower end surface 39 is inclined downward and inward, the radial component Dr of the drag D applied from the outer cylinder member 30 to the ridge 45 faces the outside of the diameter direction. Accordingly, the sandwiching force applied to the accommodation portion 22 by the outer peripheral wall 44 and the inner peripheral wall 421 decreases. That is, the load (Fr) sandwiching the lower end ridge 25 between the outer peripheral wall 44 and the inner peripheral wall 421 decreases by the drag (Dr) in the diameter direction generated by the axial load (Fa) applied from the accommodation portion 22 to the outer peripheral wall 44. For this reason, a force (drawing force) separating the lower end ridge 25 from the annular groove 41 decreases before opening the bottle cap 10, so that the opening torque of the bottle cap 10 is prevented from excessively increasing.

That is, according to the bottle cap 10 of this example, the cap portion 26 may be separated from the outer cylinder member 30 by a predetermined opening torque when the beverage bottle 100 is cooled from the normal temperature to the low temperature or even when the pressing force of the bottom cover member 40 against the inner cylinder member 20 increases.

Further, in the invention, a liquid solvent may be accommodated in the bottle cap 10 as the input material 200, and a solute such as a powdered material, a granular material, or a gelled material may be accommodated in the bottle body 210. Even in this case, when the bottle cap 10 is opened and the liquid input material 200 is input to the bottle body 210, a liquid mixed with the solutes may be obtained.

Further, in the container with the cap of the invention, at least one of the mixing material and the input material may be a medicine. For example, the input material 200 accommodated in the bottle cap 10 may be changed as a powdered or granular oral medicine, and the mixing material accommodated in the bottle body 210 may be changed as a solvent such as a liquid oral medicine or water.

Then, when the bottle cap 10 is opened so that the input material 200 (powdered oral medicine) is mixed with a solvent, a prescribed concentration of medicine may be easily prepared. Further, in this case, the input material 200 may be isolated from the solvent before a patient takes the medicine. Accordingly, even in the medicine of which the medicinal effect temporally changes due to the contact with the solvent, the container with the cap of the invention has a benefit in that the patient may take the oral medicine with high medicinal effect.

Further, the container with the cap of the invention may accommodate other materials other than the beverage. For example, the input material 200 accommodated in the bottle cap 10 may be an aroma component of perfume. Then, the user may prepare the perfume by opening the bottle cap 10 so that the aroma component is mixed with the solvent immediately before using the perfume.

Furthermore, the container with the cap of the invention may accommodate colorants, paints, adhesives, or detergents formed by mixing plural components.

Moreover, the container with the cap of the invention may be used as various types other than the above-described PET bottle. For example, in the case of a bottle shape, the container may be used as a medicine bottle, a perfume bottle, or a nursing bottle. In addition, the container with the cap may be used as a spherical or cylindrical capsule container, or a pack container having a bag shape, a block shape, a roof shape, or a tetra pod type.

The invention claimed is:

1. A cap comprising:

an inner cylinder member which includes a cylindrical accommodation portion having an open lower end so as to accommodate an input material therein and a cap portion sealing an upper end of said accommodation portion;

an outer cylinder member which includes an outer cylinder portion allowing said accommodation portion to be inserted therein by attachably/detachably and threadedly mounting said cap portion on an open upper end and allowing an open lower end to be inserted into a container opening together with said accommodation portion, and which is mounted on said container opening; and a bottom cover member which includes an annular groove, in which a lower end of said accommodation portion is raised more than said outer cylinder portion so as to be attachably/detachably press-inserted into said annular groove to be fitted thereto, thereby sealing said accommodation portion, wherein when said cap portion that is threadedly mounted on said outer cylinder member threadedly advances in an opening direction with respect to said outer cylinder member, an outer peripheral wall of said annular groove is pressed down by a lower end surface of said outer cylinder member, so that said bottom cover member is separated from said accommodation portion, wherein said lower end surface of said outer cylinder member is inclined so as to be lower toward the outside in a radial direction, and wherein a ridge is integrally formed on an upper edge of said outer peripheral wall of said annular groove by the same material as that of said outer peripheral wall, said ridge being pressed against said lower end surface of said outer cylinder member while said cap portion is threadedly mounted on said outer cylinder member;

wherein a swollen portion is inwardly formed in an inner wall surface of said upper edge of said outer peripheral wall, said swollen portion engaging with said lower end of said accommodation portion when said lower end of said accommodation portion is fitted into said annular groove, wherein said ridge is protruded further upward than said swollen portion.

2. The cap as set forth in claim 1, wherein when said cap portion is threadedly mounted on said outer cylinder member, said outer peripheral wall of said annular groove comes into pressing-contact with said lower end of said accommodation portion, and a press-contact load is applied from said lower end of said accommodation portion to said outer peripheral wall, said press-contact load including a load component applied in a direction where said ridge press-inserts said lower end surface of said outer cylinder member in the axial direction of said outer cylinder member and a load component applied outward in the diameter direction of said bottom cover member.

3. The cap as set forth in claim 1, wherein said ridge is a triangular ridge of which an outer surface is inclined downward and outward by an inclination angle ($\theta_2$) steeper than a downward inclination angle ($\theta_1$) of said lower end surface of said outer cylinder member.

4. The cap as set forth in claim 3, wherein said inclination angle ($\theta_1$) is equal to or more than 5° and equal to or less than 30°, and said inclination angle ($\theta_2$) is equal to or more than 20° and equal to or less than 45°.

5. The cap as set forth in claim 1, wherein said ridge is pressed against said lower end surface at the substantially center in the thickness direction of said outer cylinder member.

6. The cap as set forth in claim 1, wherein a second ridge is integrally formed inside said annular groove by the same material as that of said outer peripheral wall, thereby sealing a gap between said bottom cover member and said lower end of said accommodation portion by being brought into contact with said lower end.

7. The cap as set forth in claim 1, wherein said entire bottom cover member including said ridge is formed of a single material.

8. The cap as set forth in claim 1, wherein all of said inner cylinder member, said outer cylinder member, and said bottom cover member contain a polypropylene resin as a main component.

9. A container with a cap comprising:

a container body which accommodates a mixing material therein and has a container opening formed in an upper end thereof; and the cap as set forth in claim 1 mounted on said container opening of said container body, wherein when said cap portion threadedly advances so that said bottom cover member is separated from said accommodation portion, said input material is mixed with said mixing material.

10. The container as set forth in claim 9, wherein said mixing material is a beverage, and said input material is a powdered material, a granular material, a gelled material, or a liquid material that is dissolved or dispersed in said beverage.

11. The container as set forth in claim 9, wherein at least one of said mixing material and said input material is a medicine.

12. The cap as set forth in claim 1, wherein the ridge is integrally formed on an upper surface of the upper edge of said outer peripheral wall.

13. The cap as set forth in claim 1, wherein the ridge has a triangle cross section.

14. A cap comprising:

an inner cylinder member which includes a cylindrical accommodation portion having an open lower end so as to accommodate an input material therein and a cap portion sealing an upper end of said accommodation portion;

an outer cylinder member which includes an outer cylinder portion allowing said accommodation portion to be inserted therein by attachably/detachably and threadedly mounting said cap portion on an open upper end and allowing an open lower end to be inserted into a container opening together with said accommodation portion, and which is mounted on said container opening; and a bottom cover member which includes an annular groove, in which a lower end of said accommodation portion is raised more than said outer cylinder portion so as to be attachably/detachably press-inserted into said annular groove to be fitted thereto, thereby sealing said accommodation portion, wherein when said cap portion that is threadedly mounted on said outer cylinder member threadedly advances in an opening direction with respect to said outer cylinder member, an outer peripheral wall of said annular groove is pressed down by a lower end surface of said outer cylinder member, so that said bottom cover member is separated from said accommodation portion, wherein said lower end surface of said outer cylinder member is inclined so as to be lower toward the outside in a radial direction, and wherein a portion of an upper surface of an upper edge of said outer peripheral wall is provided with a protruded portion protruded from the upper surface of the upper edge of said outer peripheral wall and the protruded portion is made of the same material as that of said outer peripheral wall, the protruded portion being pressed against said lower end surface of said outer cylinder member while said cap portion is threadedly mounted on said outer cylinder member;

wherein a swollen portion is inwardly formed in an inner wall surface of said upper edge of said outer peripheral wall, said swollen portion engaging with said lower end of said accommodation portion when said lower end of said accommodation portion is fitted into said annular groove, wherein said protruded portion is protruded further upward than said swollen portion.

15. The cap as set forth in claim 14, wherein the protruded portion of the upper surface of the upper edge of said outer peripheral wall has a triangle cross section.

16. The cap as set forth in claim 14, wherein an outer portion of the upper surface of the upper edge of said outer peripheral wall is protruded from the upper surface of the upper edge of said outer peripheral wall.

17. The cap as set forth in claim 1, wherein said ridge is arranged at a position apart from said inner wall surface of said upper edge of said outer peripheral wall outward in a radial direction.

18. The cap as set forth in claim 14, wherein said protruded portion is arranged at a position apart from said inner wall surface of said upper edge of said outer peripheral wall outward in a radial direction.

19. The cap as set froth in claim 14, wherein a ridge is integrally formed inside said annular groove by the same material as that of said outer peripheral wall, thereby sealing a gap between said bottom cover member and said lower end of said accommodation portion by being brought into contact with said lower end.

* * * * *